US005942163A

United States Patent [19]

Robinson et al.

[11] Patent Number: 5,942,163

[45] Date of Patent: Aug. 24, 1999

[54] LOW PRESSURE JACKETED STEAM MANIFOLD

[75] Inventors: William Charles Robinson, Memphis, Tenn.; Jon Keith Bingaman, Three Rivers; Michael Herman Gaines, Kalamazoo, both of Mich.

[73] Assignee: Armstrong International, Inc., Stuart, Fla.

[21] Appl. No.: 08/868,298

[22] Filed: Jun. 3, 1997

[51] Int. Cl.[6] ..... B01D 1/16

[52] U.S. Cl. ..... 261/118; 261/DIG. 15; 261/DIG. 76

[58] Field of Search ..... 261/115, 116, 261/117, 118, DIG. 15, DIG. 76

[56] References Cited

U.S. PATENT DOCUMENTS

| | | | |
|---|---|---|---|
| 3,386,659 | 6/1968 | Rea . | |
| 3,724,180 | 4/1973 | Morton et al. | 261/DIG. 76 |
| 3,857,514 | 12/1974 | Clifton . | |
| 4,265,840 | 5/1981 | Bahler . | |
| 4,384,873 | 5/1983 | Herr . | |
| 4,508,135 | 4/1985 | Schlesch et al. . | |
| 4,630,633 | 12/1986 | Vallery . | |
| 4,675,505 | 6/1987 | Fischer . | |
| 5,065,785 | 11/1991 | Deacon et al. . | |
| 5,126,080 | 6/1992 | Morton et al. . | |
| 5,277,849 | 1/1994 | Morton et al. . | |
| 5,337,703 | 8/1994 | Schlesch et al. . | |
| 5,370,085 | 12/1994 | Dangreau . | |
| 5,372,753 | 12/1994 | Morton . | |
| 5,376,312 | 12/1994 | Morton et al. . | |
| 5,516,466 | 5/1996 | Schlesch et al. . | |
| 5,543,090 | 8/1996 | Morton et al. . | |

FOREIGN PATENT DOCUMENTS 6432 of 0000 United Kingdom .

OTHER PUBLICATIONS

Dri–Steem Steam Injection Humidifiers for Applications with a steam boiler, Dri–Steem Humidifier Company, 1989.

The Armstrong Humidification Handbook, pp. 18–21 Entitled "Considerations in Selecting Steam Humidifiers", 1995.

Air Eliminators—for venting unwanted Air from Steam Spaces, Armstrong Machine Works, Bulletin No. 458–B 10M, Dated Nov. 1980.

*Primary Examiner*—Jay H. Woo
*Assistant Examiner*—Robert Hopkins
*Attorney, Agent, or Firm*—MacMillan, Sobanski & Todd, LLC

[57] ABSTRACT

A jacketed steam humidification apparatus includes an elongated steam dispersion tube having discharge orifices for the release of steam, and an elongated jacket defining a jacket passageway in contact with the dispersion tube so that steam can flow along the jacket passageway to maintain the dispersion tube in a heated condition, where the jacket has one or more escape passages to allow a portion of the steam and other gases in the jacket passageway to escape from the jacket passageway.

30 Claims, 2 Drawing Sheets

LOW PRESSURE JACKETED STEAM MANIFOLD

TECHNICAL FIELD

This invention relates to steam humidification systems for supplying steam into heating and air conditioning systems or for other industrial uses of steam. More particularly, this invention pertains to steam humidification systems useful in situations where it is undesirable for the steam introduced into an airstream to condense onto any surface, but rather it is required that the steam be quickly assimilated into a passing air flow by vaporization.

BACKGROUND OF THE INVENTION

Steam humidification systems are commonly used to raise the humidity level in air flow ducts. Typical untreated air in the winter months has very low relative humidity, and it is desirable to increase the level of humidity in commercial and industrial facilities. This is particularly true for health care facilities such as hospitals and nursing homes. High relative humidity is also needed in industrial locations where static electricity is especially undesirable, such as in facilities housing electronic equipment, and in other industrial locations, such as fabric or paper handling, where a material must be prevented from drying out.

Steam humidification systems typically use dispersion tubes that are supplied with steam and have numerous orifices to discharge steam. Usually the dispersion tubes are positioned within air handling systems such as heating, ventilating and air conditioning ("HVAC") ducts to discharge steam into the air flowing through the ducts. Since the steam is warmer than the air flowing through the HVAC ducts, the air flow in the ducts has a cooling effect on the dispersion tubes, and as the steam enters the dispersion tubes, some of the steam is cooled to the extent that it condenses into water. This is to be avoided because the water can be discharged through the discharge orifices in liquid form along with the steam in vaporous form. The result is excessive dampness in the HVAC duct and other equipment, thereby providing an environment ripe for the growth of undesirable microorganisms.

Designers of steam humidification systems know that the tendency of steam to condense in the dispersion tube can be counteracted by providing a heated jacket around the dispersion tube to help maintain the dispersion tube warm enough so that condensation does not occur. A flow of steam through the jacket passageway keeps the dispersion tube from cooling off, thereby minimizing condensation in the dispersion tube. This is illustrated in U.S. Pat. No. 3,857,514 to Clifton, which shows a steam supply directed to the jacket around a dispersion tube. The steam exiting the flow-through jacket is directed to a steam control unit, where the steam is conditioned to remove condensed water and mist. Then the conditioned steam is delivered to the dispersion tube for discharge into the HVAC duct. Steam humidification systems are configured to supply steam to the jacket at a pressure within the range of from about 2 to about 60 pounds per square inch ("psi"), in order to ensure a good flow through of steam through the jacket and through the steam control unit, although a pressure within the range of from about 10 to about 15 psi is typical.

Another known system for the humidification of a flow of air is the use of an array or bank of unjacketed dispersion tubes that are enhanced with various features to prevent condensed water from being discharged from the discharge orifices along with the steam. U.S. Pat. No. 5,516,466 to Schlesch et al. shows such a system, where the discharge orifices have tiny tubes that extend into the dispersion tube to prevent condensed water from easily exiting the dispersion tube along with the flow of humidification steam. This patent also discloses baffle tubes that help increase the velocity of the air at the point of steam mixing to improve vaporization of any visible vapor exiting the dispersion tubes.

It would be desirable to be able to provide a jacketed dispersion tube humidification system where there is no requirement for a return line for steam passed through the jacket. This would substantially reduce the steam piping requirements. However, it would be expected that a jacketed dispersion tube, where there is no return for a flow-through of steam, would be unworkable. The steam would flow at a slow rate because the primary mechanism for inducing flow into the jacket is the condensation of the steam within the jacket rather than a flow through of the steam. This condensation causes a reduction in volume and resulting influx of a small amount of additional steam. A condensate return line could be provided to drain any condensed water from the bottom of the dispersion tube. Because of the low steam throughput in the jacket, such a jacketed dispersion tube would be expected to be only partially successful in maintaining the dispersion tube warm enough to provide dry steam, i.e., steam having little condensed water or mist.

Another problem to be expected with jacketed dispersion tubes designed with no flow-through is that non-condensable gases, such as air and carbon dioxide, would accumulate in the jacket. This accumulation of non-condensable gases is referred to as "air binding". Since, unlike steam, these gases cannot condense to make room for additional steam, the flow of additional hot steam into the jacket would be greatly diminished. The resulting extremely low steam flow in the jacket would be expected to prevent effective heating of the dispersion tube, and excessive unwanted condensation would be expected to occur in the dispersion tube. It would be beneficial if a jacketed dispersion tube, having no return for a flow-through of steam, could be made to successfully distribute humidification steam.

Standard humidification systems using jacketed dispersion tubes have in the past been configured to be connected to a source of high pressure steam, such as an industrial steam boiler. This requires running a steam line from the boiler to the location where the steam is to be introduced into the HVAC duct. Improvements in steam generating equipment have resulted in the availability of independent steam generators capable of being positioned close to the location where the steam is to be introduced into the HVAC duct. These independent steam generators can be, for example, electronic steam humidifiers, gas-fired steam humidifiers, or steam to steam humidifiers.

One of the characteristics of independent steam humidifiers is that they generate steam only at low pressures, usually no greater than one psi, and typically significantly less than 27 inches of water column. With such low steam pressures, it is not feasible to operate a typical jacketed steam dispersion tube of the type disclosed in U.S. Pat. No. 3,857,514 to Clifton, as described above. At such low initial pressures, the steam would not be expected to be capable of flowing through a stream control unit for conditioning. Therefore, supplying traditional jacketed dispersion tubes with low pressure steam from a low pressure steam humidifier has not been very successful. It would be advantageous if jacketed steam dispersion tubes could be operated using the steam from a low pressure steam source such as an electronic steam humidifier.

SUMMARY OF THE INVENTION

The above objects as well as other objects not specifically enumerated are achieved by a jacketed steam humidification apparatus of the non flow-through type in which the jacket has escape passages to allow a portion of the steam and other gases in the jacket passageway to escape from the jacket passageway. The escape passages allow the escape of enough steam that the flow of steam through the jacket passageway can be maintained at a level sufficient to sustain the dispersion tube in a heated condition.

According to this invention, there is provided a jacketed steam humidification apparatus including an elongated steam dispersion tube having discharge orifices for the release of steam, and an elongated jacket defining a jacket passageway in contact with the dispersion tube so that steam can flow along the jacket passageway to maintain the dispersion tube in a heated condition, the jacket having one or more escape passages to allow a portion of the steam and other gases in the jacket passageway to escape from the jacket passageway.

In another embodiment of the invention, there is provided a jacketed steam humidification apparatus including an elongated steam dispersion tube having discharge orifices for the release of steam, an elongated jacket substantially surrounding the dispersion tube, the jacket defining a jacket passageway for a flow of steam to maintain the dispersion tube in a heated condition, where the dispersion tube is connected to the jacket at an elongated line of tangency, and the discharge orifices of the dispersion tube are positioned along the line of tangency.

In another embodiment of the invention, there is provided a jacketed steam humidification apparatus including an elongated steam dispersion tube having discharge orifices for the release of steam, an elongated jacket defining a passageway in contact with the dispersion tube so that steam can flow along the jacket passageway to maintain the dispersion tube in a heated condition, a common supply conduit for supplying steam to both the steam dispersion tube and the jacket, and a divider for splitting the flow of steam and directing a first portion into the dispersion tube and a second portion into the jacket passageway, so that the steam supplied to the jacket passageway is at a pressure no greater than the pressure of the steam supplied to the dispersion tube.

In another embodiment of the invention, there is provided a method for providing steam for humidification including the steps of supplying steam to an elongated steam dispersion tube having discharge orifices for the release of steam, supplying steam to a jacket passageway formed by an elongated jacket, the passageway being in contact with the dispersion tube to maintain the dispersion tube in a heated condition, maintaining the dispersion tube in a heated condition by causing the steam in the jacket passageway to flow along the passageway, discharging steam from the discharge orifices of the dispersion tube, and allowing a portion of the steam and other gases in the jacket passageway to escape from the jacket passageway through one or more escape passages.

In another embodiment of the invention, there is provided a method for providing steam for humidification including the steps of supplying steam to an elongated steam dispersion tube having discharge orifices for the release of steam, supplying steam to a jacket passageway formed by an elongated jacket, the passageway being in contact with the dispersion tube to maintain the dispersion tube in a heated condition, the steam being supplied to the jacket passageway at a pressure, measured in the jacket passageway, less than about 27 inches of water, maintaining the dispersion tube in a heated condition by causing the steam in the jacket passageway to flow along the jacket passageway, and discharging steam from the discharge orifices of the dispersion tube.

DETAILED DESCRIPTION AND PREFERRED EMBODIMENTS OF THE INVENTION

Figure 1:
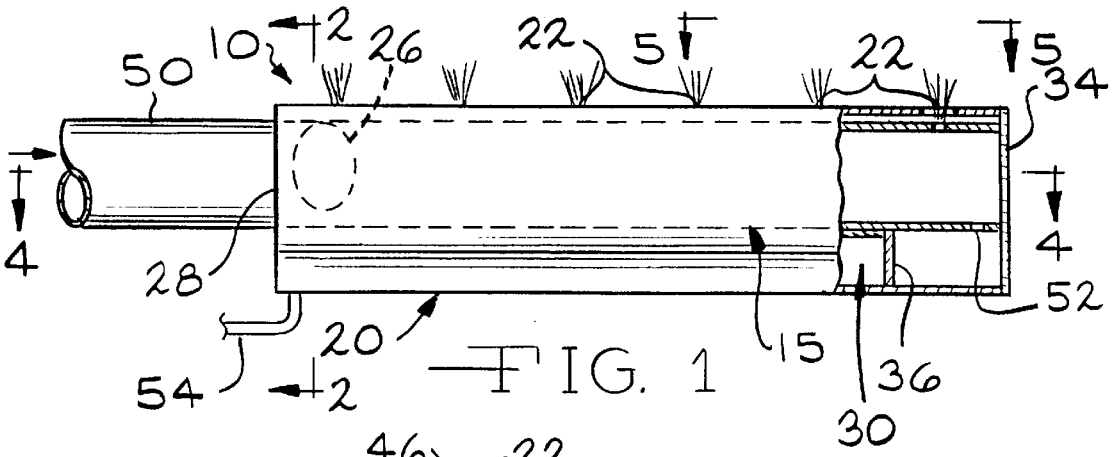
FIG. 1 is a schematic view in elevation, partially in cross-section, of a jacketed steam humidification apparatus made according to the invention.
Figure 2:
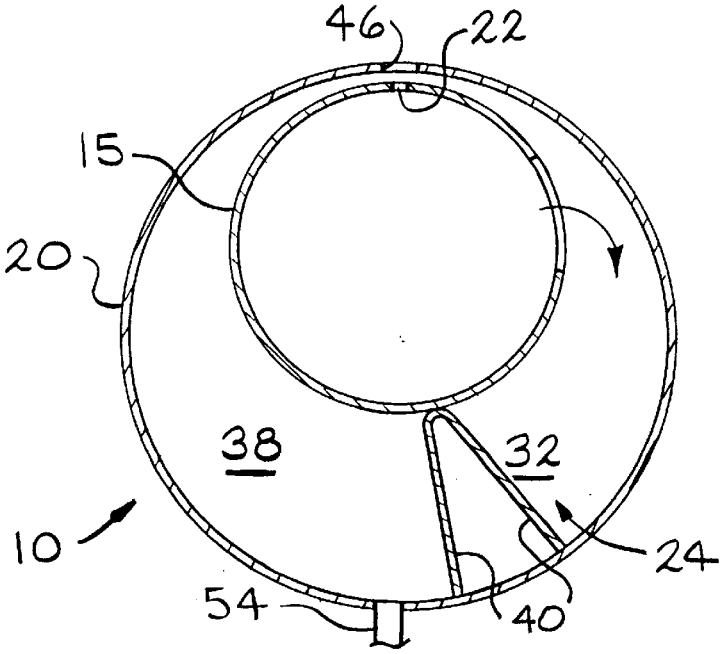
FIG. 2 is a schematic cross-sectional view in elevation of the jacketed steam humidification apparatus of FIG. 1, taken along line 2—2.

As shown in FIGS. 1 and 2, the jacketed steam humidification apparatus of the invention is indicated generally at 10. The apparatus includes a dispersion tube 15 which is surrounded by a jacket 20. The dispersion tube 15 is provided with holes or discharge orifices 22 that allow steam to escape from the dispersion tube and mingle with the air that is to be humidified. The dispersion tube can be made of any suitable material for conveying steam, such as stainless steel, as is known by those skilled in the art.

The discharge orifices 22 can be any orifices suitable for allowing the steam to exit the dispersion tube. The orifices can be of any shape or size suitable for the exit of steam. The discharge orifices can be provided with small diameter tubes, not shown, to discourage the inducement of liquid, condensed water by the flow of steam exiting the dispersion tube via the discharge orifices. Alternatively, the discharge can be provided with any other type of fittings, such as nozzles, not shown, to facilitate the proper disbursement of steam from the dispersion tubes. In order to provide the optimum dispersion of steam into the air to be humidified, the dispersion tube 15 is elongated so that the discharge orifices 22 can be spread out, preferably evenly, over a wider area to increase the mixing of the steam into the air handling system and to prevent condensation of moisture within the air handling system. In a heating and air conditioning duct (HVAC duct), for example, the dispersion tube is preferably sized to extend across the entire width of the HVAC duct.

The jacket 20 is also elongated, and it defines a jacket passageway 24 through which steam can flow. The jacket passageway is in contact with the dispersion tube so that the dispersion tube can be maintained in a heated condition. The purpose of the jacket is to prevent the air flowing past the dispersion tube from unduly cooling the dispersion tube. Excessive cooling of the dispersion tube causes too much condensation, often resulting in excessive discharge of condensed water from the discharge orifices.

Figure 4:
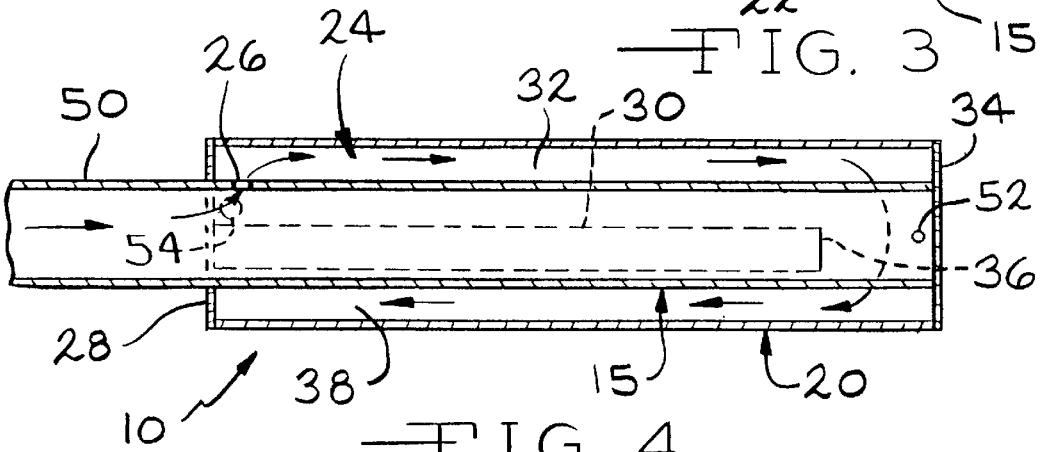
FIG. 4 is a schematic cross-sectional plan view of the jacketed steam humidification apparatus of FIG. 1, taken along line 4—4, and illustrating the flow of steam through the jacket.

As shown in FIG. 2, the jacket 20 and the jacket passageway 24 nearly completely surround the dispersion tube. The dispersion tube 15 is provided with a jacket inlet 26 at the supply end 28 of the dispersion tube so that steam can enter the jacket passageway 24 from the dispersion tube. A baffle 30 is optionally positioned between the jacket 20 and the dispersion tube, extending along almost the entire length of the humidification apparatus 10 to direct the flow of steam. As seen more clearly by the flow arrows in FIG. 4, the steam entering the jacket passageway 24 via the jacket inlet 26 first flows through the first passageway leg 32 toward the distal end 34 of the humidification apparatus 10, then around the end 36 of the baffle 30, and then finally back through the second passageway leg 38 toward the supply end 28 of the humidification apparatus 10. The baffle 30 can be of any suitable material or shape sufficient to direct the flow of steam along the first and second passageway legs 32 and 38. As shown in FIG. 2, the baffle optionally can be formed by two longitudinal baffle legs 40 arranged in the shape of an inverted V for increased support of the dispersion tube and increased structural stability of the humidification apparatus.

While the dispersion tube 15 and the jacket 20 can be of any shape suitable for dispersing relatively dry steam, a preferred configuration is shown in FIG. 2, where both the dispersion tube and the jacket each have generally circular cross-sections. The dispersion tube can be mounted or attached within the jacket merely by bonding the jacket 20 to the dispersion tube at both the supply end 28 and the distal end 34 of the humidification apparatus. The connection or bonding of the dispersion tube and jacket to each other can be by any means, such as by welding. A bond or weld along the whole length of the humidification apparatus is not necessary since one object of the apparatus is to allow some steam to escape. Instead, the jacket 20 can be loosely overlapping the dispersion tube to allow leakage. As shown in FIG. 2, the dispersion tube 15 can be positioned inside the jacket 20 and at a tangent to the jacket 20. The discharge orifices 22 are positioned along the elongated line of tangency 44, as more explicitly shown in FIG. 5. Regardless of where or how the dispersion tube and the jacket are bonded together, it can be said that they are "connected" to each other along the line of tangency 44 because that is where there is a common line or region of close proximity, if not actual contact.

Figure 3:
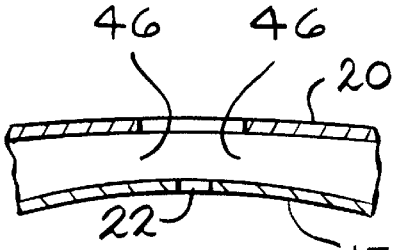
FIG. 3 is a schematic view illustrating greater detail of a portion of the jacketed steam humidification apparatus shown in FIG. 2.
Figure 5:
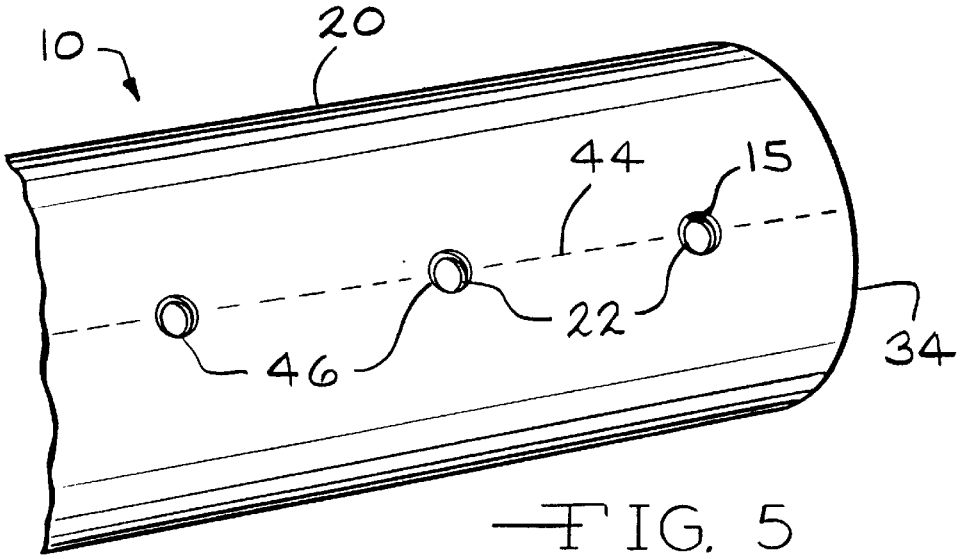
FIG. 5 is a schematic view in perspective of a portion of the jacketed steam humidification apparatus of FIG. 1, taken along line 5—5.

As shown in FIGS. 2 and 3, the jacket passageway 24 is provided with one or more escape passages 46 that allow steam to escape from the jacket passageway and into the atmosphere. The escape passages 46 can be positioned anywhere along the length of the jacket 20 for enabling steam to vent from the jacket passageway. Venting steam from the jacket passageway 24 via the escape passages 46 maintains a flow of fresh steam into the jacket passageway so that the temperature of the 1dispersion tube will be sustained in a heated condition. Preferably there are a plurality of escape passages 46 positioned along the length of the jacket. As shown in FIG. 5, the discharge orifices 22 can be arranged in a generally linear array, with the escape passageways 46 also arranged along the line of tangency 44. The escape passages 46 are preferably generally aligned on centers with the discharge orifices 22, as shown. By positioning the escape passages close to the discharge orifices, as shown, the natural inducement of the flow of steam from the discharge orifices can be taken advantage of, and the flow of humidification steam from the discharge orifices will draw out or induce steam from the jacketed area. The positioning of the escape passages along the line of tangency 44, i.e., where the dispersion tube is connected to the jacket, enables the flow of steam through the discharge orifices 22 of the dispersion tube to draw out steam and other gases from the jacket passageway 24. The term "connected", for purposes of this invention, means extending along in a common line or region of close proximity or actual contact.

Even though the jacket 20 is configured for a flow of steam through the jacket passageway 24, the jacketed steam humidification apparatus of the invention is considered to be of the non-flow through type because there is no return outlet for the return or recovery of steam. This is in contrast to the above-mentioned U.S. Pat. No. 3,857,514 to Clifton, which provides a complete flow through of steam from the steam supply pipe 14, through the jacket inlet coupling 51, through the jacket inlet passage 43, through the outlet passage 44, and through the outlet coupling 52 to the steam return pipe 16. The only means by which steam can pass out from the jacket passageway in the apparatus of the present invention is by exiting through the escape passages 46 (or in the form of condensate via a condensate drain, as will be explained below.)

One of the advantages of the jacketed steam humidification apparatus of the invention is that non-condensable gases can be vented from the jacket passageway 24. In the absence of the escape passageways, the only mechanism for removing gases from the jacket passageway of a non flow-through system is to condense the gases into liquids, and to remove the condensed gases via a condensate drain. This is a common method for removal of condensable gases, such as steam, from steam process lines. Unfortunately, some gases are essentially non-condensable at typical steam line temperatures, including such gases as $CO_2$ and air. Without an effective means of escape, these non-condensable gases could accumulate within the jacket passageway 24 and prevent the influx of new steam into the jacket passageway, thereby greatly limiting the ability of the jacket and jacket passageway to effectively maintain the desired temperature of the dispersion tube.

In an alternate design, in order to effect a flow of steam through the entire jacket passageway 24, the escape passages could be provided in the second passageway leg 38 only, in an arrangement not shown, with no escape passages being positioned in the first passageway leg 32.

As shown in FIG. 1, the steam is supplied to the dispersion tube 15 by means of a supply conduit 50. Since the steam entering the jacket passageway 24 comes from the dispersion tube via the jacket inlet 26, the supply conduit 50 is a common supply conduit for supplying steam to both the dispersion tube and the jacket passageway. The jacket inlet 26 acts as a divider to split the flow of steam and to direct a first portion of the steam into the dispersion tube, and a second portion into the jacket passageway. It is to be understood that any type of divider, capable of separating a single flow of steam into separate flows for the dispersion tube and the jacket passageway, can be used. For example, a simple baffle could be inserted in a common steam flow supply line to divide the flow.

In the preferred embodiment of the invention, a dispersion tube drain 52 is provided in the bottom of the dispersion tube to enable condensed water to be removed from the dispersion tube, thereby avoiding a buildup of water in the dispersion tube which could be drawn out from the dispersion tube via the discharge orifices. Also, a condensate drain 54 can be placed in the bottom of the jacket 20 so that condensed water can be removed in a similar manner.

Figure 6:
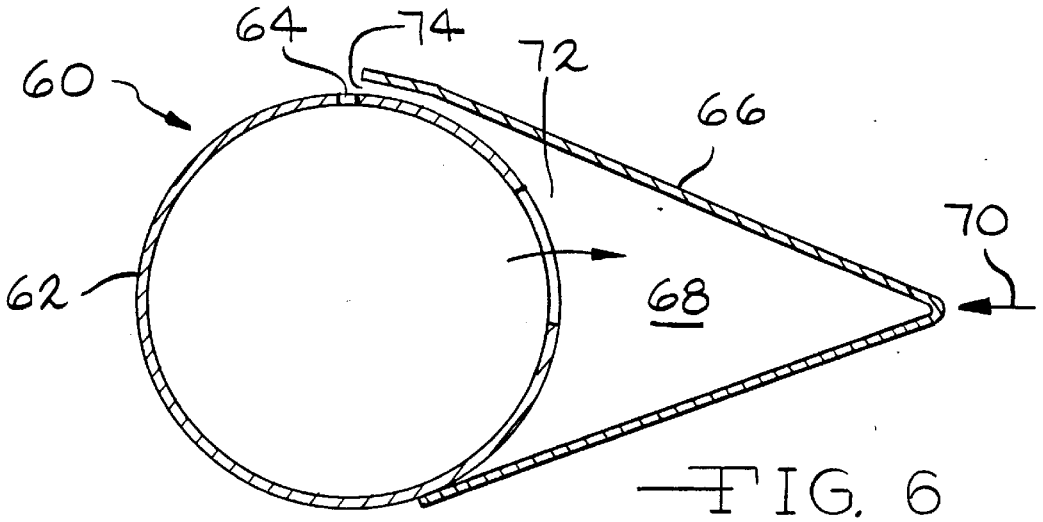
FIG. 6 is a cross-sectional view in elevation, similar to the view shown in FIG. 2, of a different embodiment of the invention, where the jacket does not totally enclose the dispersion tube.

As shown in FIG. 6, an alternate embodiment the humidification apparatus of the invention can be arranged with the jacket and jacket passageway placed on only one side of the dispersion tube, rather than surrounding the entire dispersion tube as shown in FIGS. 1–5. The humidification apparatus 60 includes a dispersion tube 62 having discharge orifices 64, and a jacket 66 defining a jacket passageway 68 which is on only one side of the dispersion tube 62. The dispersion tube 62, jacket 66, and jacket passageway 68 all preferably extend longitudinally in a manner similar to the embodiment of the humidification apparatus shown in FIGS. 1–5 so that a plurality of discharge orifices 64 can be arranged in an array along the length of the apparatus. The directional arrow 70 indicates the direction of the flow of air past the humidification apparatus 60. The jacket and jacket passageway are preferably positioned on the upstream side of the dispersion tube to provide the heat to the dispersion tube where it is needed the most. A portion of the steam entering the dispersion tube 62 is released into the jacket passageway 68 via the jacket inlet 72. Some of the steam in the jacket passageway 68 is vented via the escape passageways 74 to enable a generally continuous flow of steam through the jacket passageway 68.

Figure 7:
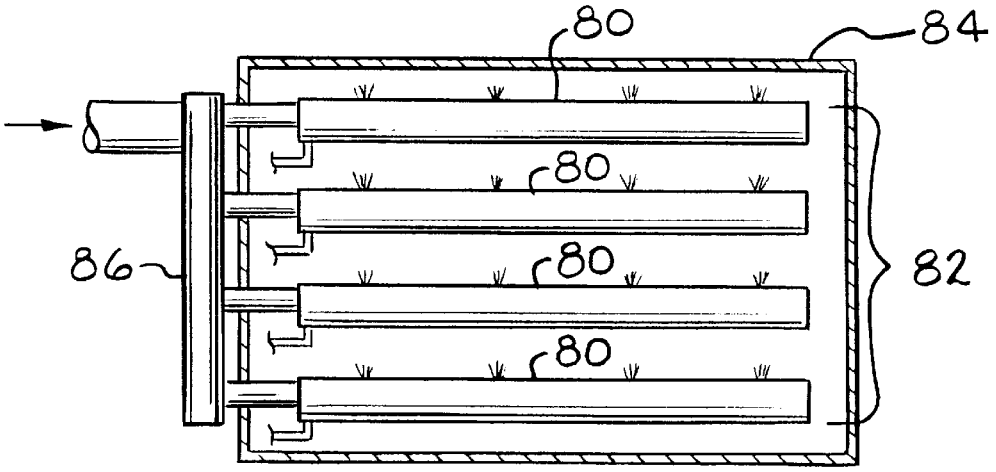
FIG. 7 is a schematic view in elevation of a bank of jacketed dispersion tubes of the invention, positioned within an HVAC duct.

As shown in FIG. 7, more than one steam humidification apparatus can be used at one time. Each steam humidification apparatus consists of jacketed dispersion tube 80 similar to those previously described, and a plurality of them can be formed into a bank 82 of jacked dispersion tubes, which can be inserted into an HVAC duct 84, or any other air handling system. For purposes of this invention, an air handling system is any stream of air which is controlled and/or directed, and which can be modified by adding humidification. Optionally, all of the jacketed dispersion tubes can be supplied with steam from a common supply header 86.

One of the advantages of the humidification systems of the invention is that the steam pressure within the jacket passageway does not need to be at a high level. Therefore, the humidification system of the invention can be operated using electronic steam humidifiers or other steam generators generating steam only at low pressures. For example, the humidification systems of the invention can operate under supply pressures no greater than about one psi, and typically significantly less than 27 inches of water column. Steam sources generating steam at these pressures are sometimes referred to as "atmospheric" steam generators. In the humidification apparatus the supply pressure is measured in the common supply conduit 50 just before the steam reaches the supply end 28. In a specific embodiment of the invention, the supply pressure is within the range of from about the duct static pressure to about 5 inches of water pressure above the duct static pressure, where the duct static pressure is the static pressure in the duct at the location of the dispersion tube 15. The pressure can be measured by any suitable means, such as a negative pressure gauge or a water manometer. The pressure within the jacket passageway 24, as measured in the jacket passageway 24, usually will be lower than the supply pressure because of the many escape passages 46 that enable the steam to vent. Also, the pressure within the jacket passageway 24, as measured in the jacket passageway, usually will be lower than the pressure of the steam in the dispersion tube, measured just downstream from the supply end 28 of the dispersion tube. In a specific embodiment of the invention, the steam is supplied to the jacket passageway 24 at a pressure less than about 27 inches of water, as measured within the jacket passageway 24. This pressure is the pressure relative to the static pressure in the duct, i.e., the "duct static" pressure. Also, the humidification apparatus of the invention is capable of operating at low throughput, such as, for example, at a rate within the range of from about 4 to about 120 lbs. per hour, and more typically within the range of from about 4 to about 40 lbs. per hour when the system is calling for more steam. In a specific embodiment of the invention, the steam is supplied to the jacket at a rate within the range of from about 4 to about 20 lbs. per hour.

The principle and mode of operation of this invention have been described in its preferred embodiment. However, it should be noted that this invention may be practiced otherwise than as specifically illustrated and described without departing from its scope.

What is claimed is:

1. A jacketed steam humidification apparatus comprising:

an elongated steam dispersion tube having discharge orifices for the release of steam; and an elongated jacket defining a jacket passageway in contact with the dispersion tube so that steam can flow along the jacket passageway to maintain the dispersion tube in a heated condition, the jacket having one or more escape passage means for allowing a portion of the steam and other gases in the jacket passageway to escape from the jacket passageway through the one or more escape passages.

2. The steam humidification apparatus of claim 1 in which the dispersion tube is connected to the jacket, and the escape passages are positioned where the dispersion tube is connected to the jacket so that the flow of steam through the discharge orifices of the dispersion tube will draw out steam and other gases from the jacket passageway.

3. The steam humidification apparatus of claim 1 including a common supply conduit for supplying steam to both the steam dispersion tube and the jacket passageway, and a divider for splitting the flow of steam and directing a first portion of the steam into the dispersion tube and a second portion of the steam into the jacket passageway.

4. The steam humidification apparatus of claim 1 in which the jacket passageway surrounds the dispersion tube and contains a longitudinal baffle which divides the jacket passageway into a first passageway leg for directing steam from a supply end of the jacket passageway toward a distal end of the jacket passageway, and a second passageway leg for directing steam around an end of the baffle and back toward the supply end of the jacket.

5. The steam humidification apparatus of claim 4 in which the jacket has a generally circular cross-section, and the dispersion tube has a generally circular cross-section.

6. The steam humidification apparatus of claim 1 where the discharge orifices of the dispersion tube are in a generally linear array, and where the dispersion tube is positioned at a tangent to the inside of the jacket along the array of discharge orifices, with the dispersion tube being loosely connected to the jacket to define the escape passages, and with the escape passages close to the discharge orifices so that the flow of steam through the discharge orifices will draw out steam and other gases from the jacket passageway through the escape passages.

7. The steam humidification apparatus of claim 1 in combination with one or more additional substantially identical steam humidification apparatus to form a bank of jacketed dispersion tubes suitable for use in an air handling system.

8. A jacketed steam humidification apparatus comprising:

an elongated steam dispersion tube having discharge orifices for the release of steam; and an elongated jacket substantially surrounding the dispersion tube, the jacket defining a jacket passageway for a flow of steam to maintain the dispersion tube in a heated condition, the jacket having one or more escape passages, means for allowing a portion of the steam and other gases in the jacket passageway to escape from the jacket passageway through the one or more escape passages, wherein the dispersion tube is connected to the jacket at an elongated line of tangency, and the discharge orifices of the dispersion tube are positioned along the line of tangency.

9. The steam humidification apparatus of claim 8 where the jacket passageway has one or more escape passages to allow a portion of the steam and other gases in the jacket passageway to escape from the jacket passageway, where the escape passages are positioned where the dispersion tube is connected to the jacket passageway along the elongated line of tangency so that the flow of steam through the discharge orifices of the dispersion tube will draw out steam and other gases from the jacket passageway.

10. The steam humidification apparatus of claim 8 in which the jacket passageway contains a longitudinal baffle which divides the jacket passageway into a first passageway leg for directing steam from a supply end of the jacket passageway toward a distal end of the jacket passageway, and a second passageway leg for directing steam around an end of the baffle and back toward the supply end of the jacket.

11. A jacketed steam humidification apparatus comprising:

an elongated steam dispersion tube having discharge orifices for the release of steam; and an elongated jacket defining a jacket passageway in contact with the dispersion tube so that steam can flow along the jacket passageway to maintain the dispersion tube in a heated condition, the jacket having one or more escape passage means for allowing a portion of the steam and other gases in the jacket passageway to escape from the jacket passageway through the one or more escape passages;

a common supply conduit for supplying steam to both the steam dispersion tube and the jacket; and a divider for splitting the flow of steam and directing a first portion into the dispersion tube and a second portion into the jacket passageway, so that the steam supplied to the jacket passageway is at a pressure no greater than the pressure of the steam supplied to the dispersion tube.

12. The steam humidification apparatus of claim 11 in which the divider is a jacket inlet orifice in the dispersion tube.

13. The steam humidification apparatus of claim 11 including a condensate return drain for the removal of water condensed from steam in the jacket passageway.

14. The steam humidification apparatus of claim 11 including a condensate return drain for the removal of water condensed from steam in the dispersion tube.

15. A method for providing steam for humidification comprising:

supplying steam to an elongated steam dispersion tube having discharge orifices for the release of steam;

supplying steam to a jacket passageway formed by an elongated jacket, the passageway being in contact with the dispersion tube to maintain the dispersion tube in a heated condition;

maintaining the dispersion tube in a heated condition by causing the steam in the jacket passageway to flow along the passageway;

discharging steam from the discharge orifices of the dispersion tube; and allowing a portion of the steam and other gases in the jacket passageway to escape from the jacket passageway through one or more escape passage means for allowing a portion of the steam and other gases in the jacket passageway to escape from the jacket passageway through the one or more escape passages.

16. The method of claim 15 where the jacket passageway escape passages are positioned close to the dispersion tube discharge orifices so that the flow of steam through the discharge orifices will draw out steam and other gases from the jacket through the escape passages.

17. The method of claim 15 including supplying steam to both the dispersion tube and the jacket passageway from a common supply conduit.

18. The method of claim 15 in which the steam is supplied to the jacket at a rate within the range of from about 4 to about 20 lbs. per hour.

19. A method for providing steam for humidification comprising:

supplying steam to an elongated steam dispersion tube having discharge orifices for the release of steam;

supplying steam to a jacket passageway formed by an elongated jacket, the passageway being in contact with dispersion tube to maintain the dispersion tube in a heated condition, the steam being supplied to the jacket passageway at a pressure, measured in the jacket passageway, that is lower than the pressure of the steam in the dispersion tube, measured at a supply end of the dispersion tube;

maintaining the dispersion tube in a heated condition by causing the steam in the jacket passageway to flow along the passageway; discharging steam from the discharge orifices of the dispersion tube; and discharging a portion of the steam and other gases from the jacket passageway through one or more escape passage means for allowing a portion of the steam and other gases in the jacket passageway to escape from the jacket passageway through the one or more escape passages.

20. The method of claim 19 in which the steam is supplied to the jacket passageway at a pressure less than about 27 inches of water.

21. The method of claim 19 including allowing a portion of the steam and other gases in the jacket passageway to escape from the jacket passageway through one or more escape passages.

22. The method of claim 19 where the jacket passageway escape passages are positioned close to the dispersion tube discharge orifices so that the flow of steam through the discharge orifices will draw out steam and other gases from the jacket through the escape passages.

23. The method of claim 19 including supplying steam to both the dispersion tube and the jacket passageway from a common supply conduit.

24. The method of claim 23 in which the steam pressure in the common supply conduit is within the range of from about the duct static pressure to about 5 inches of water pressure above the duct static pressure, where the duct static pressure is the static pressure in the duct at the location of the dispersion tube.

25. The method of claim 19 in which the steam is supplied to the jacket at a rate within the range of from about 4 to about 20 lbs. per hour.

26. A method for providing steam for humidification comprising:

supplying steam to an elongated steam dispersion tube having discharge orifices for the release of steam;

supplying steam to a jacket passageway formed by an elongated jacket, the passageway being in contact with the dispersion tube to maintain the dispersion tube in a heated condition, the steam being supplied to the jacket passageway at a pressure, measured in the jacket passageway, that is less than about 27 inches of water, measured at a supply end of the dispersion tube;

maintaining the dispersion tube in a heated condition by causing the steam in the jacket passageway to flow along the passageway;

discharging steam from the discharge orifices of the dispersion tube; and discharging a portion of the steam and other gases from the jacket passageway through one or more escape passage means for allowing a portion of the steam and other gases in the jacket passageway to escape from the jacket passageway through the one or more escape passages.

27. The method of claim 26 in which the steam is supplied to the jacket passageway at a pressure within the range of from about the duct static pressure to about 5 inches of water pressure above the duct static pressure, where the duct static pressure is the static pressure in the duct at the location of the dispersion tube.

28. The method of claim 26 including allowing a portion of the steam and other gases in the jacket passageway to escape from the jacket passageway through one or more escape passages.

29. The method of claim 26 including supplying steam to both the dispersion tube and the jacket passageway from a common supply conduit.

30. The method of claim 26 in which the steam is supplied to the jacket at a rate within the range of from about 4 to about 20 lbs. per hour.

* * * * *